US006243889B1

(12) United States Patent
Ducharme et al.

(10) Patent No.: US 6,243,889 B1
(45) Date of Patent: Jun. 12, 2001

(54) THERMO-ACOUSTIC INSULATION SYSTEM FOR SANITARY DEVICE

(75) Inventors: Robert Ducharme, Ste-Anne-des-Prairies; Régis Giguère, Québec; Bruno Pimparé, Ste-Marie-de-Beauce, all of (CA)

(73) Assignee: Maax Inc., Ste-Marie-de-Beauce (CA)

( * ) Notice: Subject to any disclaimer, the term of this patent is extended or adjusted under 35 U.S.C. 154(b) by 0 days.

(21) Appl. No.: 09/541,977

(22) Filed: Apr. 3, 2000

(51) Int. Cl.[7] ..... A61H 33/02

(52) U.S. Cl. ..... 4/545; 4/541.1; 4/584; 4/592

(58) Field of Search ..... 4/541.1, 545, 584, 4/506, 538, 592, 612; 52/783.1

(56) References Cited

U.S. PATENT DOCUMENTS 3,934,278 * 1/1976 Schrock ..... 4/592
4,669,133 * 6/1987 Biecher et al. ..... 4/592
5,345,621 9/1994 Livingston .
5,960,489 10/1999 Hanel et al. .
6,011,336 1/2000 Mathis et al. .

* cited by examiner

*Primary Examiner*—Gregory L. Huson
*Assistant Examiner*—Tuan Nguyen
(74) *Attorney, Agent, or Firm*—Francois Martineau

(57) ABSTRACT

The whirlpool tub includes a rigid tub shell inserted into the opening of a surrounding podium. The tub is to be filled with hot water. A first insulation membrane is installed spacedly around the tub inside the podium, defining a first closed air pocket between the tub and this first insulation membrane. A second insulation membrane is installed spacedly around the first insulation membrane, also inside the podium, defining a second closed air pocket between the first and the second membranes. The first membrane is punctured and hangs loosely from the podium structure, thus allowing limited air circulation between the first and second air pockets. Consequently, positive condensation control is accomplished, preventing same from occurring, in addition to providing thermal and acoustic insulation to the tub. The first membrane comprises an inner reflective metallic foil fixedly mounted on a synthetic felt backing. The second membrane is a mineral wool blanket.

19 Claims, 7 Drawing Sheets

THERMO-ACOUSTIC INSULATION SYSTEM FOR SANITARY DEVICE

FIELD OF THE INVENTION

The present invention relates to sanitary devices such as bathtubs, shower stalls, whirlpool baths and the like, and more particularly to a thermo-acoustic insulation system for such sanitary devices.

BACKGROUND OF THE INVENTION

It is known to provide thermal insulation for bathtubs, whirlpool baths or spas, as shown in U.S. Pat. No. 5,345,621 issued in 1994, inventor D. R. Livingston. The purpose of this insulation is to prevent the water temperature inside the tub, during use, from dropping too fast, which alternately requires the tub to be filled again with warmer water if no heater is provided, or the heater to spend more energy heating the water, if a heater is provided.

The Livingston patent shows that the bathtub shell comprises a rigid fiberglass layer, provided on its interior surface with a smooth acrylic coating, and on its outer surface with an urethane foam insulation layer. The tub is installed in a wood skirt or podium structure, which spacedly surrounds the shell and on which the shell upper downturned peripheral edge rests. Livingston also discloses the use of an insulation blanket 30 which, as shown in FIG. 3 of the Livingston patent, forms an inverted dome to completely enclose the shell, spacedly therefrom. Thus, an air pocket is formed between the shell and the insulating blanket which promotes enhanced insulation for the whirlpool tub.

The insulating blanket of the Livingston patent is made from a multiple-layer plastic film (e.g. including air bubbles therein), provided with a sheet of aluminum or the like reflective metallic foil on the inner surface thereof, in spaced facing register with the urethane foam coating of the tub shell. It is known that the metallic foil will promote reflection of the heat irradiating from the tub back towards the tub.

A problem with the spa disclosed in the Livingston patent, is that its single insulating air pocket is not sufficient to prevent significant temperature loss of the water. indeed, the urethane foam layer is not efficient enough to prevent the water from loosing its energy therethrough, and even the insulating blanket is not efficient enough to prevent the water temperature to drop at a significant rate at room temperature. Furthermore, the Livingston tub provides a fluid-tight air pocket between the tub shell and the insulating blanket which, under the important temperature gradients present on one side of this air pocket in the tub water and on the other side of this air pocket in the ambient air, will promote important condensation and humidity accumulation in the air pocket. This high humidity percentage and condensation in this pocket is likely to result in mould formation, and the urethane foam is effectively likely to degenerate and rot over time, thus becoming less efficient, in addition to any hygiene problems which may result therefrom.

A further problem with prior art whirlpool tubs such as the Livingston tub, is that the noise emitted by the whirlpool tub, with its water pump, is at a high level.

It is noted that the problems noted hereinabove, occur not only in whirlpool bathtubs, but also in spas, ordinary bathtubs, shower stalls, therapeutic tubs, and the like.

The so-called therapeutic tubs are similar to whirlpool bathtubs, but include air jets injected in the water, instead of water jets. Some tubs combine both water and air jets. Throughout the present specification, reference will be made to sanitary devices as including all of the above-mentioned devices.

OBJECTS OF THE INVENTION

It is an object of the invention to provide a thermal insulation system for sanitary devices.

It is another object of the present invention to provide an acoustic insulation system for sanitary devices.

It is yet another object of the invention to provide a thermal insulation system which helps prevent humidity formation in the tub casing or podium.

SUMMARY OF THE INVENTION

The present invention relates to an insulation system for use in a sanitary device of the type including a rigid shell mounted inside an outer ground-bearing structure, said insulation system comprising:

- a first insulating membrane, destined to be installed peripherally about the sanitary device shell and spacedly therefrom inside the ground-bearing structure, so as to form a first closed air pocket between the sanitary device shell and said first insulating membrane; and
- a second insulating membrane, destined to be installed peripherally about said first insulating membrane and spacedly therefrom inside the ground-bearing structure, so as to form a second closed air pocket between said first and second insulating membranes;

wherein said first and second air pockets and said first and second insulating membranes provide enhanced thermal and acoustic insulation to the sanitary device.

Preferably, said system further includes condensation control elements in said first and second air pockets.

Preferably, said condensation control elements are air circulation channels provided on or about said first insulating membrane, for allowing limited air circulation between said first and second air pockets through and/or about said first insulating membrane.

Preferably, said air circulation channels are perforations provided throughout said first insulating membrane.

Preferably, said first insulating membrane is destined to loosely hang from the sanitary unit structure, said air circulation channels further including spaces about said first membrane allowing limited air circulation between said first and second air pockets around said first insulating membrane.

Preferably, said first membrane comprises an inner reflective metallic foil fixedly mounted on a synthetic felt backing.

Preferably, said metallic foil is aluminum.

Preferably, said second insulating membrane is a mineral wool blanket

The present invention further relates to an insulation system for use in a sanitary device of the type including a rigid shell mounted inside an outer ground-bearing structure, said insulation system comprising a first closed pocket member at least partly surrounding the sanitary device, a second closed pocket member surrounding said first pocket member, a first insulating membrane mounted between said first and second air pockets, and a second insulating membrane mounted outwardly of said second air pocket, thus creating a two-step thermal and acoustic insulation of the sanitary device.

The present invention further relates to a whirlpool-type bathtub assembly, including:

- a tub resting on the ground and having a shell defining an upper open mouth and an inner enclosure destined to be filled with warm water;
- a rigid podium structure resting on the ground, peripherally surrounding said tub shell under said open mouth;

a first pocket member located peripherally around said tub under said open mouth and inside said podium structure, defining a first closed air pocket located between: (a) said tub shell; (b) the ground; and (c) a first insulating membrane attached to the podium structure and spaced from said tub shell;

a second pocket member, located peripherally around said first pocket member, and defining a second closed air pocket located between: (a) said first insulating membrane; (b) the ground; (c) said podium structure; and (d) a second insulating membrane located spacedly and peripherally outwardly of said first insulating membrane;

wherein said first and second pocket members allow for thermal and acoustic insulation of said tub while providing positive condensation control inside said podium structure.

Preferably, said firs insulating membrane comprises a reflective metallic foil fixedly mounted to a synthetic felt backing, said metallic foil including perforations therethroughout allowing limited air circulation through said first membrane between said first and second air pockets.

Preferably, said second insulating membrane is made from a mineral wool blanket.

Preferably, said first insulating membrane is attached to said podium structure and loosely hangs therefrom to the ground, thus allowing limited air circulation thereunder between said first and second air pockets.

Preferably, said assembly further comprises vibration control pads spacing said tub from the ground.

Preferably, said assembly further comprises either one of a water-pump system, an air-jet system, and the combination of a water pump and an air-jet system, wherein said either one of a water-pump system, said air jet system, and said combination of a water pump and an air-jet system is supported over ground by an anti-vibration pad.

The present invention further relates to a method for thermally and acoustically insulating a whirlpool-type bathtub assembly of the type comprising a tub having a shell defining an upper open mouth and an inner enclosure destined to be filled with warm water, and a rigid podium structure resting on the ground and peripherally surrounding said tub shell under said open mouth;

said method comprising the following steps:

a) installing an outer insulating mineral wool blanket peripherally around said tub shell and spacedly therefrom and inside said podium structure;

b) installing inside said podium structure an inner insulating membrane comprising an inner metallic reflective foil sheet fixedly mounted on an outer synthetic felt backing, said inner insulating membrane being installed spacedly inwardly from said outer mineral wool blanket but spacedly outwardly from said tub shell so as to form a first air pocket between said tub shell and said inner insulating membrane, and a second air pocket between said inner insulating membrane and said outer mineral wool blanket; and c) fixedly attaching said inner insulating membrane to said podium structure so that it loosely hangs to the ground from an upper edge thereof to form a skirt peripherally outwardly spaced from said tub shell.

DETAILED DESCRIPTION OF THE EMBODIMENTS

Figure 1:
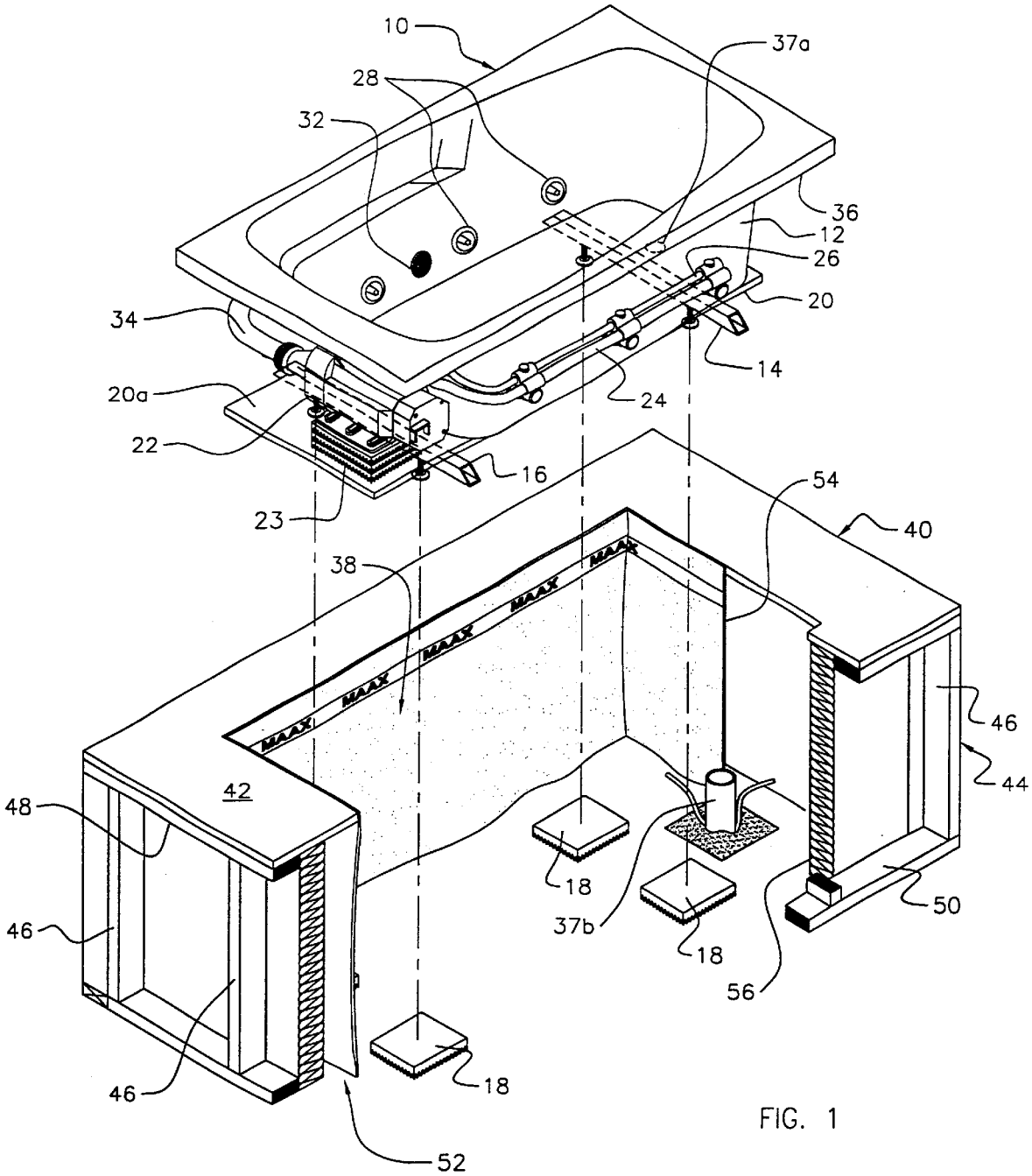
FIG. 1 is a perspective view showing a whirlpool bathtub out of its podium, the latter being partly cut-away to show the inner layers thereof, with the thermo-acoustic system according to the present invention.
Figure 2:
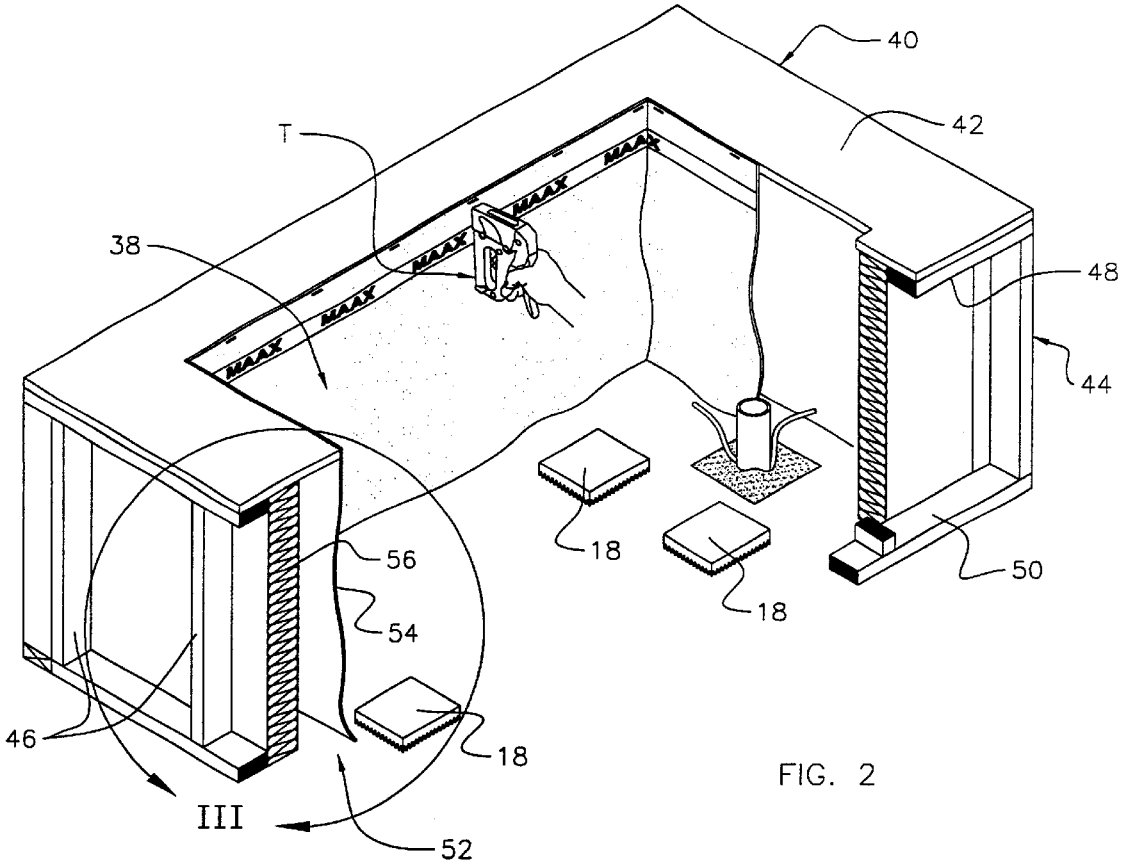
FIG. 2 is a view similar to FIG. 1, although without the bathtub, and further showing how the insulating membrane can be fixed to the podium.
Figure 3:
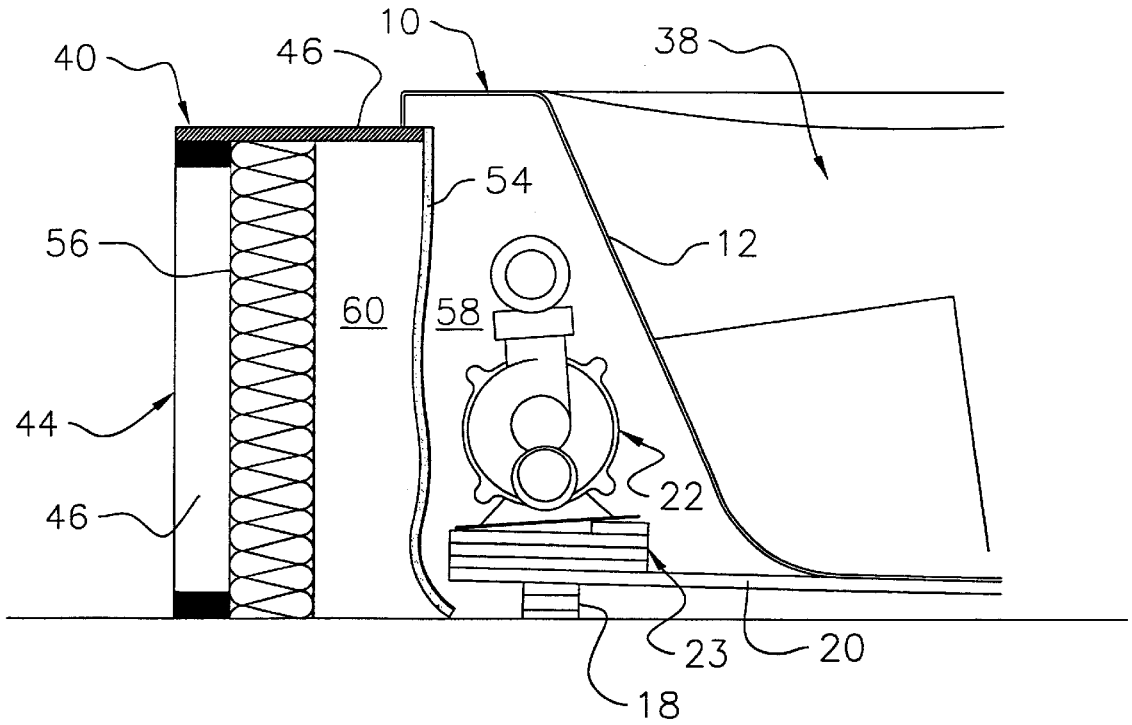
FIG. 3 is a lateral cross-sectional elevation of the area III of FIG. 2, further showing the end portion of the bathtub shell and the water pump device.

FIGS. 1 to 3 show a conventional whirlpool bathtub 10 including a rigid shell 12 supported over ground by means of a pair of spaced-apart transverse support bars 14, 16 resting on ground-bearing vibration-control pads 18. A rigid plate member 20 is installed between bars 14, 16 and shell 12, with a water pump system 22 being provided on a protruding end portion 20*a* of plate member 20. An anti-vibration pad 23 is installed between pump 22 and plate 20. As known in the art, water pipes 24, 26 will convey the water from pump 22 to inject the water through a number of nozzles 28 extending through the tub shell 12, inside the tub hollow inner enclosure 30. An outlet port 32 allows the water filled tub shell 12 to feed pump 22 with water, which is sucked up through an outlet pipe 34 back into pump 22 to repeat the cycle. A drain hole 37*a* connected to a drain pipe 37*b* allows tub 10 to be selectively emptied. Tub shell 12 is provided with an upper downturned marginal edge portion 36.

As further known in the art, tub 10 is installed into the hollow central opening 38 of a skirt or podium 40, e.g. made of wood, which rests on the ground. The downturned edge portion 36 of the tub shell 12 is destined to abut flatly on top of the podium upper panel 42, the latter not having however any load-bearing role since tub 10 is supported by pads 18. A water-tight seal (not shown) is conventionally installed between the podium upper panel 42 and the tub shell marginal edge portion 36 to prevent water spilled out of tub shell 12 to seep between shell 12 and podium 40.

Podium 40 includes a rigid frame structure 44 which can be formed of a number of upright posts 46 spacing upper and lower horizontal struts 48 and 50. Outer decorative panels (not shown) are usually provided on the peripheral outer surface of frame structure 44.

According to the present invention, there is provided inside podium 40, a thermo-acoustic insulation system 52.

Insulation system 52 comprises a first insulating membrane 54 attached to the upper edge of the podium upper panel 42 and which loosely hangs therefrom to the ground. Membrane 54 is formed of a reflective metallic foil on its inner side, fixedly attached to an outer synthetic felt backing or the like material. Preferably, the felt backing comprises polypropylene and polyethylene fibers. Such a membrane is of known construction. The metallic foil is preferably perforated all over its surface with very small holes, such as would be formed by piercing the foil with needle tips. As shown in FIG. 2, membrane 54 can be simply attached to the inner edge portion of podium upper panel 42 with a conventional fastener tool T, with membrane 54 then forming an inner skirt in podium 40.

Insulation system 52 is further provided with a conventional mineral wool or fiberglass insulation blanket 56 which is peripherally installed spacedly outwardly about membrane 54. Blanket 56 can be simply installed in a self-standing fashion, or alternately can be attached to the frame structure 44 of podium 40.

According to the system of the present invention, there is provided a first and a second closed air spaces or air pockets 58 and 60, respectively between the tub shell 12 and insulating membrane 54, and between membrane 54 and the mineral wool layer 56, as can be well seen in FIG. 3. Furthermore, due to the loose hanging of membrane or skirt 54 from the inner edge of the podium upper panel 42 to ground level, and to the fact that the foil of membrane 54 is perforated, there is a fluid communication at a limited rate which is allowed between the first and the second air spaces 58 and 60. Thus, two concentric annular air pockets 58, 60 are present about the bathtub 10, with an insulation material forming the outer surface of each one of these air pockets 58, 60. The limited fluid communication between the first and the second air pockets 58, 60, with an insulating barrier 54, 56 being located externally of both pockets 58, 60, allows a two step temperature gradient to occur between the bathtub water and the outer, ambient air. This, in addition to providing enhanced insulating properties to the whirlpool tub, advantageously helps to control the humidity inside podium 40. Tests have been done by the applicant on a bathtub according to the present invention, and the humidity control has been such that no condensation at all has occurred inside podium 40, which is of course highly desirable.

As shown, it is advantageous that the pump 22 and all the hot water circulation pipes be entirely located inside the first air pocket 58, so that this air pocket 58 take advantage of the heat emanating therefrom. The reflective foil helps to maintain a warm temperature inside the first air pocket 58, thus reducing significantly the heat loss from the water in tub 10.

The insulating membrane 54 has an inner reflective surface, for reflecting the heat irradiating from the hot tub water through the tub shell 12 during use. The outer felt layer of membrane 54 will serve both for thermally and acoustically insulating the bathtub 10. The outer mineral wool layer 56 also both thermally and acoustically insulates tub 10.

Applicant has discovered that all the above-noted advantages of the thermo-acoustic insulation system 52 according to the present invention, have yielded positive and unexpected results, both acoustically and thermally. These results can be evaluated from the graphs of FIGS. 4 to 7 which show comparative characteristics of tubs measured by applicant in a controlled environment.

Figure 4:
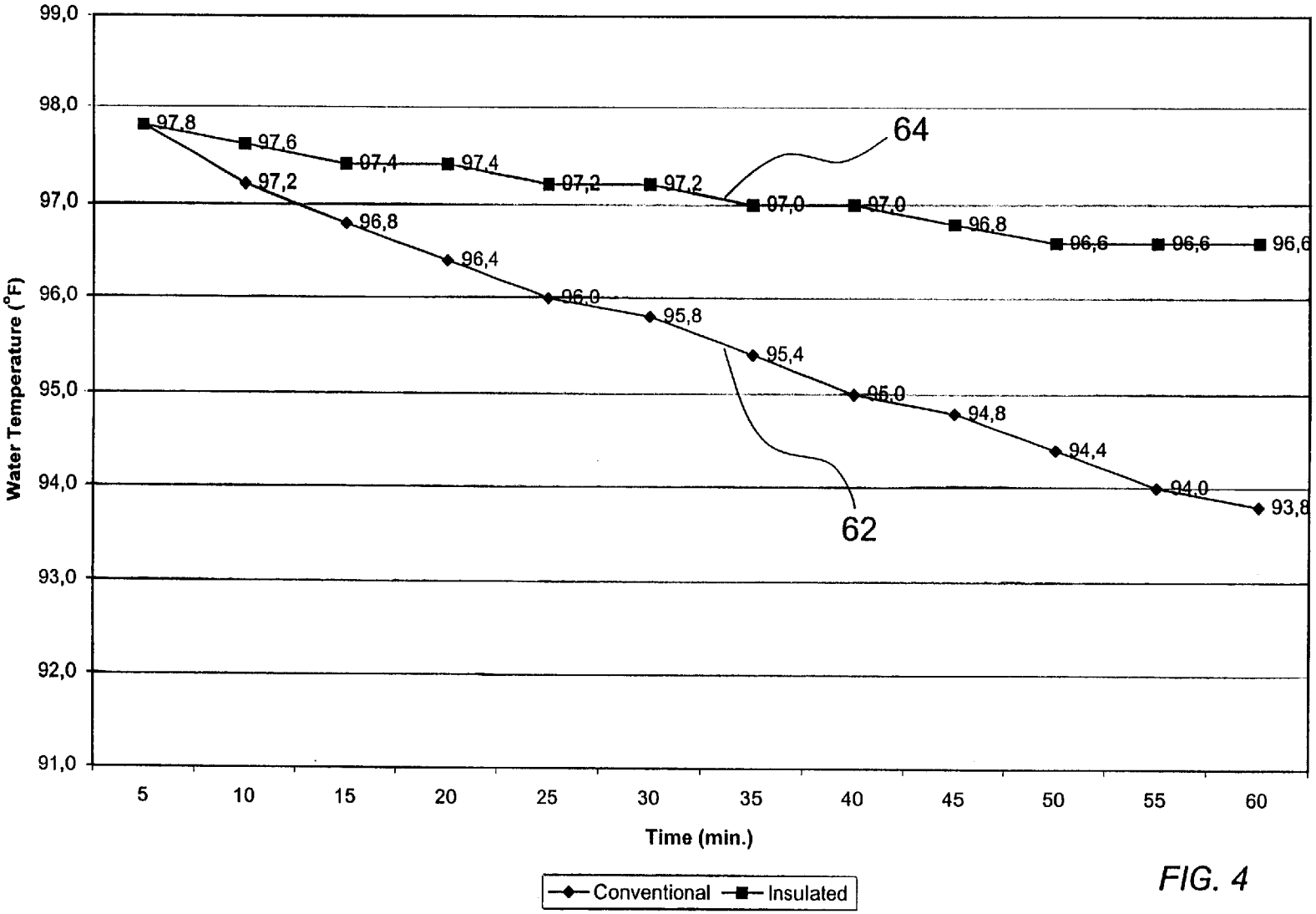
FIGS. 4 and 5 are graphs showing water temperature gradients in a whirlpool bathtub, for a non-insulated tub and a tub insulated with the system according to the present invention, for tubs devoid of and including a water heater system respectively.

The graph of FIG. 4, with water temperature on the Y axis and the timeline on the X axis, shows water temperature gradients measured in water located in a conventional, non-insulated whirlpool bathtub (curve 62), and for water located in a whirlpool bathtub insulated with the system according to the present invention (curve 64). No water heater is used in this case, and the water temperature is initially measured at 97,8° F. immediately after it has been poured to fill the tub. It can be seen that, over an hour, while the water in the conventional tub has dropped of 4° F., the water in the insulated tub has dropped only of 1.2° F. Thus only 33% of the water temperature decrease from the conventional tub, has occurred in the insulated tub. The effect of the tub insulation is thus significant.

Figure 5:
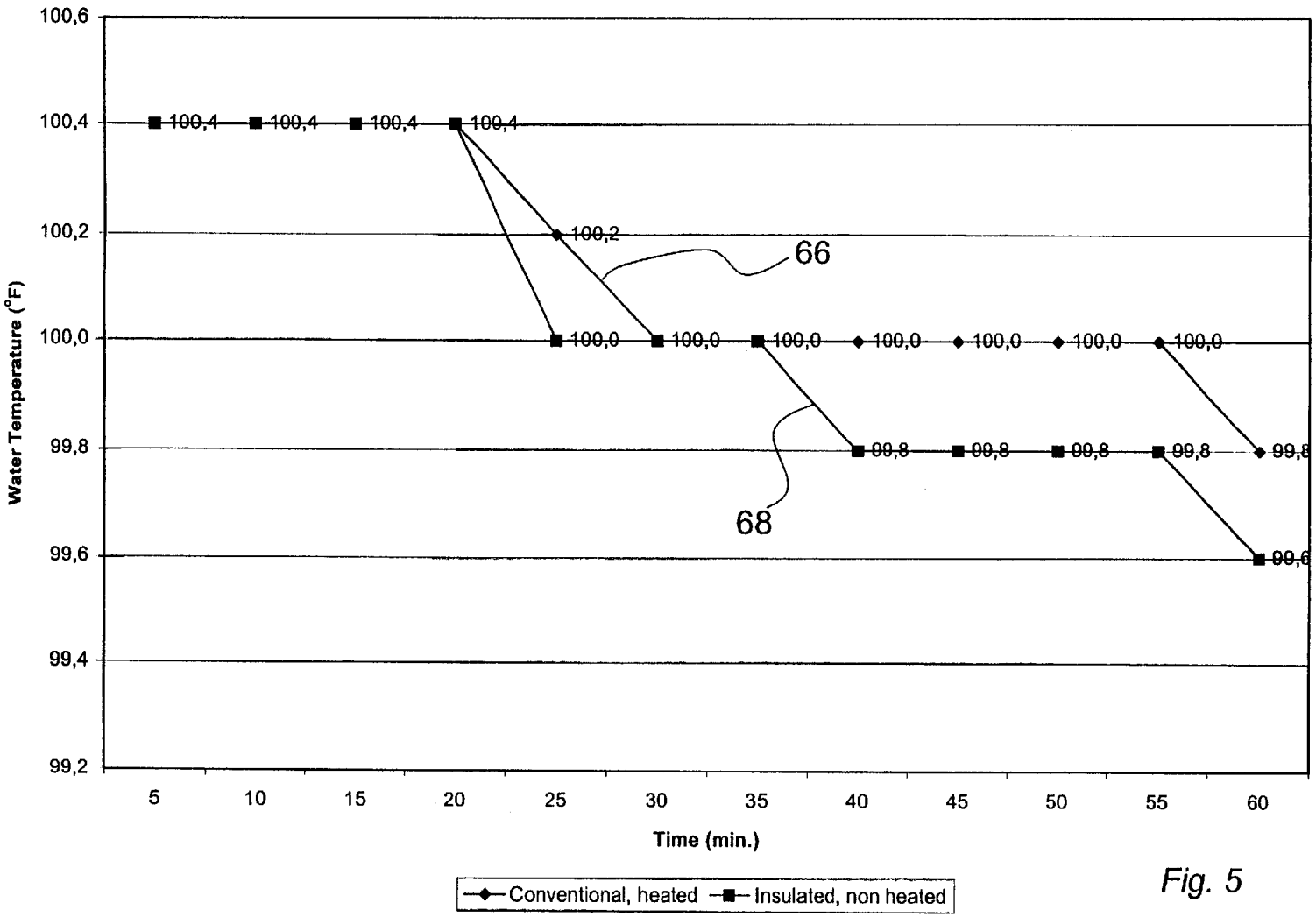

The graph of FIG. 5, with same X and Y axes parameters as with FIG. 4, shows water temperature gradients measured in water located in a conventional, non-insulated whirlpool bathtub provided with a water heater (curve 66), and for water located in a whirlpool bathtub insulated with the system according to the present invention which is not provided with a water heater (curve 68). It can be seen that for water temperatures initially measured at 100.4° F. in the two tubs, the water temperature variation over an hour is small, i.e. in the case of the conventional heated tub, the water temperature drops to 99,8° F.; while with the tub insulated according to the system of the present invention, the water temperature drops to 99,6° F. Thus, over an hour, the water temperature remains essentially the same in the conventional, non-insulated, heated tub as in the non-heated, insulated tub of the present invention. Consequently, the insulation system of the present invention could render the water heating device obsolete where ambient temperatures remain relatively warm (approximately 70° F.); while a tub subjected to cold temperatures, such as whirlpool bathtubs used outside in cold weather, would not require its water to be heated as much.

It is noted that to obtain the results in both graphs of FIGS. 4 and 5, the ambient room temperature was regulated at 71.6° F.+/−1.0° F. Also, the water temperature curves have been slightly modified to provide the exact same initial temperatures on both curves. Indeed, water temperatures between two different tests could vary of up to approximately 1° F. To allow the comparative temperature values to be more readily appreciated from the graphs, the initial temperature difference between two tests on a same graph was added to each temperature value of the curve having the lowest initial temperature.

Figure 6:
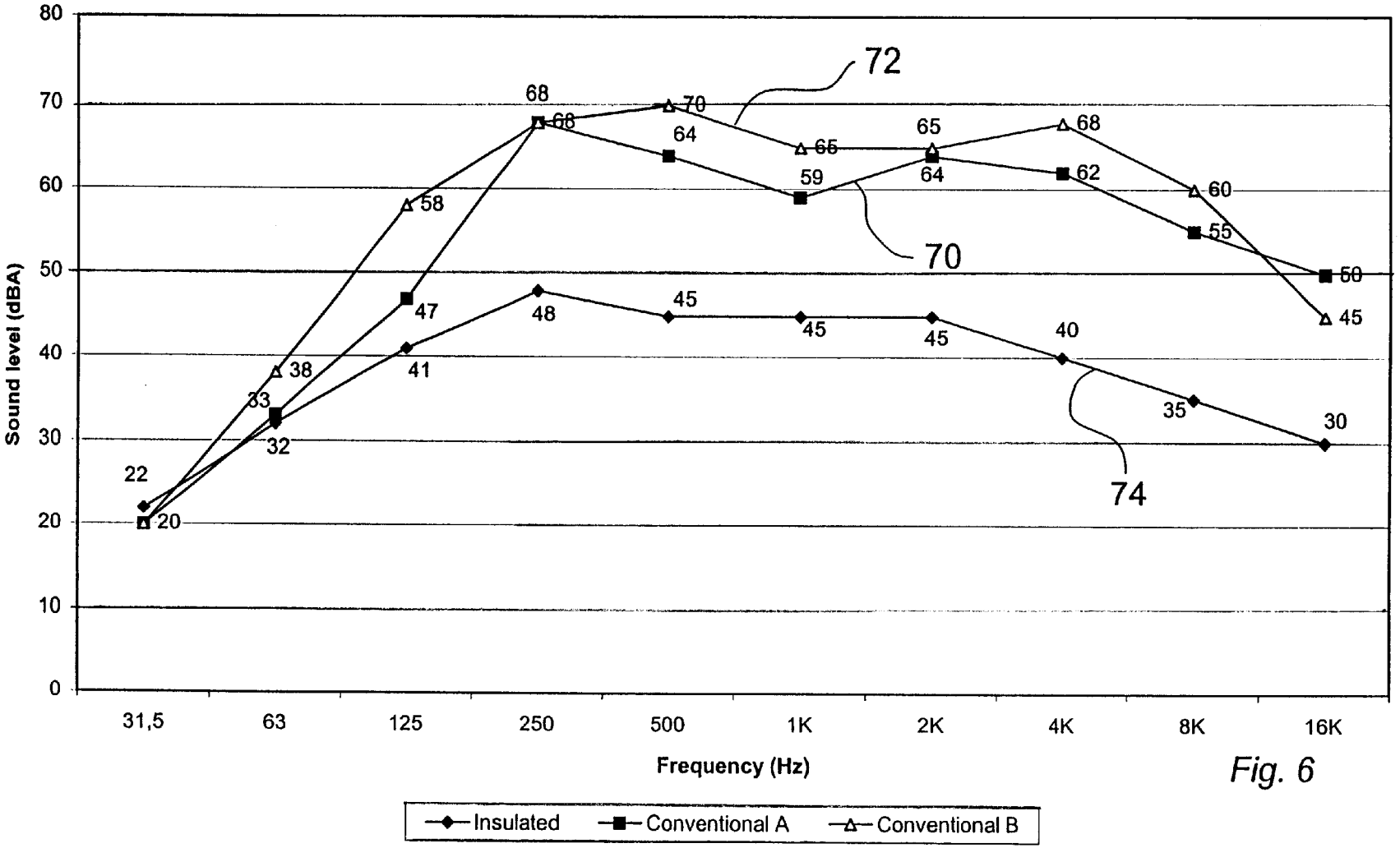
FIGS. 6 and 7 are graphs showing acoustic pressure levels emitted by a therapeutic tub and a whirlpool tub respectively, for conventional tubs and a tub provided with the insulating system according to the present invention.

The graph of FIG. 6, with sound intensity on the Y axis and sound wave frequency on the X axis, shows three curves of the sound levels emitted by operating therapeutic bathtubs (i.e. with air jets) at different frequencies. The sound originates mainly from the air injection motors and the vibrations induced thereby in the tub structure. Curve 70 represents the sound levels (in decibels) emitted by a first non insulated conventional tub, called conventional tub A; curve 72 is associated to a second non-insulated conventional tub, called conventional tub B; and curve 74 is associated to a tub insulated with the system according to the present invention. Conventional tub A is manufactured by the present applicant, and is similar to the tub used for the measurements of the insulated tub, although it lacks the insulation system of the invention. Conventional tub B is a tub sold and manufactured by another supplier of the therapeutic bathtub industry. It can be seen that in the wide range of sound wave frequencies where the measurements have been made, the tub according to the present invention emits significantly less sound than the conventional tubs, except in very low sound wave frequencies. This is especially true in light of the fact that the decibel scale is logarithmic, and thus a small change on the graph in the number of decibels emitted by a tub, results in a very important difference in the sound level captured by the human ear. The general sound level received by the human ear for each tub, is as follows: conventional tub A emits 73 dBA, conventional tub B emits 75 dBA, and the insulated tub according to the invention emits 53 dBA.

Figure 7:
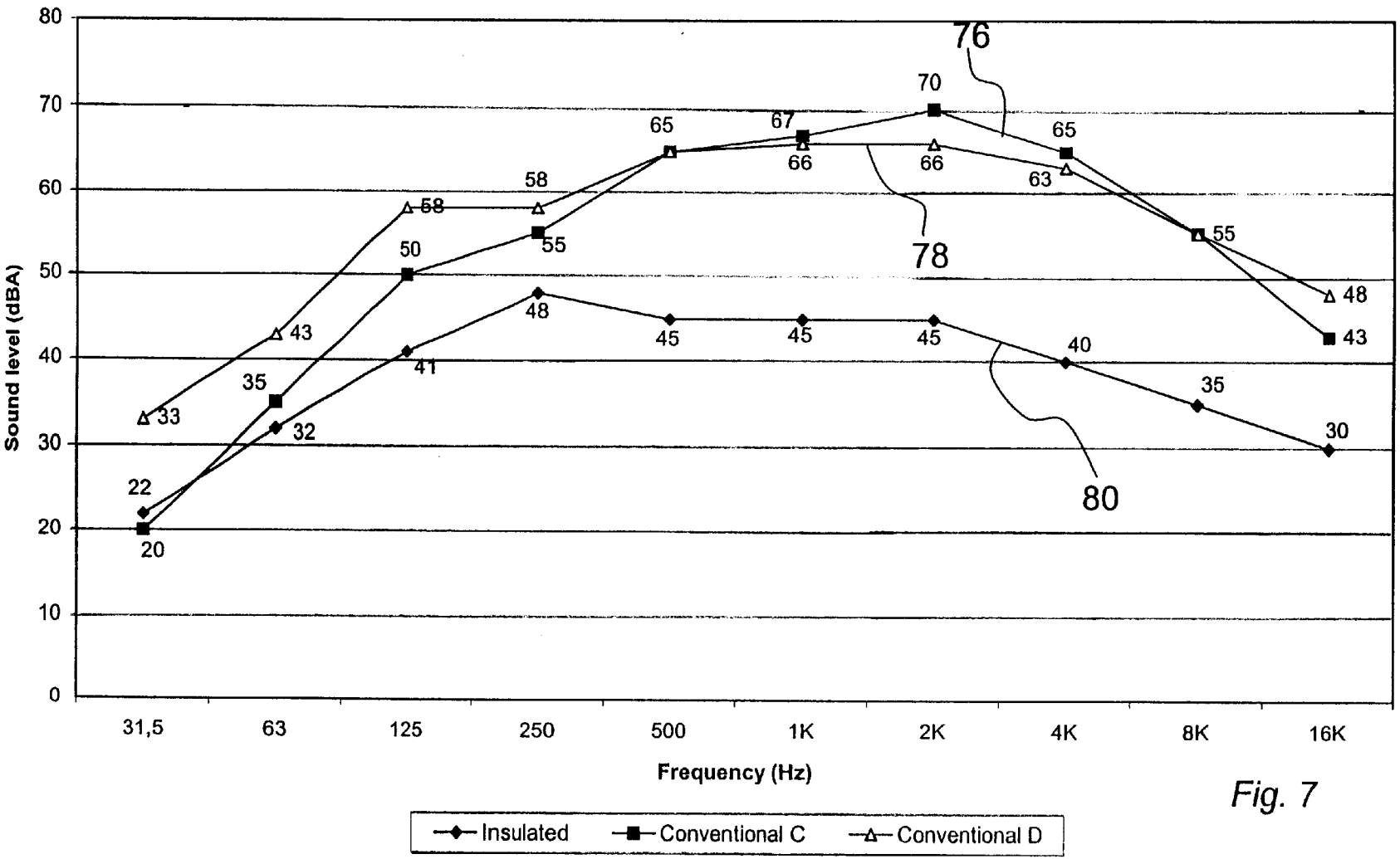

The graph of FIG. 7 is similar in X and Y axes parameters than that of FIG. 6, but shows sound level measurements taken on operating whirlpool tubs (i.e. with water injection nozzles) instead of therapeutic tubs, at different sound wave frequencies. The sound emitted originates mainly from the water circulating motor and the vibrations induced thereby. The curve 76 represents the sounds emitted by a conventional tub C manufactured by the present applicant; the curve 78 represents the sounds emitted by a conventional tub D manufactured by another supplier of the whirlpool tub industry; and curve 80 represents the sound emitted by the tub provided with the insulation system of the present invention. It can be seen again that the sound level of the tub insulated with the system of the invention is significantly lower and that of the conventional tubs. The general sound level received by the human ear for each tub, is as follows: conventional tub C emits 74 dBA, conventional tub B emits 71 dBA, and the insulated tub according to the invention emits 53 dBA.

It can thus be seen, from the comparative results obtained by testing a tub equipped with the insulating system according to the present invention and other conventional tubs, that the insulation system according to the present invention yields very advantageous and highly unexpected results, both thermally and acoustically. This is true for all whirlpool-type tubs (i.e. whirlpool tubs, therapeutic tubs, and combined water-jet and air-jet tubs). It is further envisioned that other types of sanitary devices, such as conventional bathtubs, shower stalls and the like, be also equipped with the insulation system according to the present invention.

It is understood that any further modification to the present invention, which does not deviate from the scope thereof, is considered to be included therein.

For example, although it is preferred that an inner insulating membrane including a metallic foil mounted on a synthetic felt backing be used as the inner membrane, other inner insulating membrane could be used to achieve similar results. Also, a second suitable outer insulating membrane could also be used instead of the mineral wool blanket described in the present specification.

Furthermore, it is envisioned to provide different air circulation systems between the first and the second air pockets 58, 60 located inside the podium 40. Small pipes, or any other suitable communication devices could be used instead of the first membrane 54 being perforated and loosely hanging from the podium structure 44 to allow limited air circulation between the first and second air pockets 58, 60.

We claim:

1. An insulation system for use in a sanitary device of the type including a rigid shell mounted inside a rigid podium structure peripherally surrounding said sanitary device and resting on the ground, said insulation system comprising:

a first insulating membrane, destined to be installed peripherally about the sanitary device shell and spacedly therefrom inside the podium structure, so as to form a first closed air pocket between the sanitary device shell and said first insulating membrane; and a second insulating membrane, destined to be installed peripherally about said first insulating membrane and spacedly therefrom inside the podium structure, so as to form a second closed air pocket between said first and second insulating membranes;

wherein said first and second air pockets and said first and second insulating membranes provide enhanced thermal and acoustic insulation to the sanitary device.

2. An insulation system as defined in claim 1, further including condensation control elements in said first and second air pockets.

3. An insulation system as defined in claim 2, wherein said condensation control elements are air circulation channels provided on or about said first insulating membrane, for allowing limited air circulation between said first and second air pockets through and/or about said first insulating membrane.

4. An insulation system as defined in claim 3, wherein said air circulation channels are perforations provided throughout said first insulating membrane.

5. An insulation system as defined in claim 4, wherein said first insulating membrane is destined to loosely hang from the sanitary unit structure, said air circulation channels further including spaces about said first membrane allowing limited air circulation between said first and second air pockets around said first insulating membrane.

6. An insulation system as defined in claim 3, wherein said first insulating membrane is destined to loosely hang to the ground from the sanitary unit structure, said air circulation channels including spaces about said first membrane allowing limited air circulation between said first and second air pockets around said first insulating membrane.

7. An insulation system as defined in claim 6, wherein said air circulation channels further include perforations provided throughout said first insulating membrane.

8. An insulation system as defined in claim 1, wherein said first membrane comprises an inner reflective metallic foil fixedly mounted on a synthetic felt backing.

9. An insulation system as defined in claim 8, wherein said metallic foil is aluminum.

10. An insulation system as defined in claim 8, wherein said metallic foil is perforated.

11. An insulation system as defined in claim 10, wherein said second insulating membrane is a mineral wool blanket.

12. An insulation system as defined in claim 1, wherein said second insulating membrane is a mineral wool blanket.

13. A whirlpool-type bathtub assembly, including:

a tub resting on the ground and having a shell defining an upper open mouth and an inner enclosure destined to be filled with warm water;

a rigid podium structure resting on the ground, peripherally surrounding said tub shell under said open mouth;

a first pocket member located peripherally around said tub under said open mouth and inside said podium structure, defining a first closed air pocket located between: (a) said tub shell; (b) the ground; and (c) a first insulating membrane attached to the podium structure and spaced from said tub shell;

a second pocket member, located peripherally around said first pocket member, and defining a second closed air pocket located between: (a) said first insulating membrane; (b) the ground; (c) said podium structure; and (d) a second insulating membrane located spacedly and peripherally outwardly of said first insulating membrane;

wherein said first and second pocket members allow for thermal and acoustic insulation of said tub while providing positive condensation control inside said podium structure.

14. An assembly as defined in claim 13, wherein said first insulating membrane comprises a reflective metallic foil fixedly mounted to a synthetic felt backing, said metallic foil including perforations therethroughout allowing limited air circulation through said first membrane between said first and second air pockets.

15. An assembly as defined in claim 14, wherein said second insulating membrane is made from a mineral wool blanket.

16. An assembly as defined in claim 15, wherein said first insulating membrane is attached to said podium structure and loosely hangs therefrom to the ground, thus allowing limited air circulation thereunder between said first and second air pockets.

17. An assembly as defined in claim 13, further comprising vibration control pads spacing said tub from the ground.

18. An assembly as defined in claim 17, further comprising either one of a water-pump system, an air jet system, and the combination of a water pump and an air-jet system, wherein said either one of a water-pump system, said air jet system, and said combination of a water pump and an air-jet system is supported over ground by an anti-vibration pad.

19. A method for thermally and acoustically insulating a whirlpool-type bathtub assembly of the type comprising a tub having a shell defining an upper open mouth and an inner enclosure destined to be filled with warm water, and a rigid podium structure resting on the ground and peripherally surrounding said tub shell under said open mouth;

said method comprising the following steps:

a) installing an outer insulating mineral wool blanket peripherally around said tub shell and spacedly therefrom and inside said podium structure;

b) installing inside said podium structure an inner insulating membrane comprising an inner metallic reflective foil sheet fixedly mounted on an outer synthetic felt backing, said inner insulating membrane being installed spacedly inwardly from said outer mineral wool blanket but spacedly outwardly from said tub shell so as to form a first air pocket between said tub shell and said inner insulating membrane, and a second air pocket between said inner insulating membrane and said outer mineral wool blanket; and c) fixedly attaching said inner insulating membrane to said podium structure so that it loosely hangs to the ground from an upper edge thereof to form a skirt peripherally outwardly spaced from said tub shell.

* * * * *